US005968892A

United States Patent [19]

Hutchins

[11] Patent Number: 5,968,892

[45] Date of Patent: Oct. 19, 1999

[54] NON-BRITTLE LAUNDRY BARS COMPRISING COCONUT ALKYL SULFATE AND POLYETHYLENE GLYCOL

[76] Inventor: James Peyton Hutchins, The Procter & Gamble Company, Ivorydale Technical Center, 5299 Spring Grove Ave., Cincinnati, Ohio 45217

[21] Appl. No.: 08/847,406

[22] Filed: Apr. 24, 1997

Related U.S. Application Data

[63] Continuation of application No. 08/516,969, Aug. 18, 1995, abandoned, which is a continuation of application No. 08/261,611, Jun. 17, 1994, abandoned.

[51] Int. Cl.[6] ..... C11D 17/00

[52] U.S. Cl. ..... 510/447; 510/156; 510/440; 510/450

[58] Field of Search ..... 510/133, 141, 510/152, 154, 155, 156, 440, 447, 450

[56] References Cited

U.S. PATENT DOCUMENTS

| | | | |
|---|---|---|---|
| 3,622,517 | 11/1971 | Norton | 252/554 |
| 4,163,732 | 8/1979 | Sai et al. | 252/550 |
| 4,240,920 | 12/1980 | de Luque | 252/99 |
| 4,256,597 | 3/1981 | Sakkab | 252/99 |
| 4,335,025 | 6/1982 | Barker et al. | 252/550 |
| 4,543,204 | 9/1985 | Gervasio | 252/531 |
| 4,861,508 | 8/1989 | Wegeher et al. | 252/121 |
| 4,968,451 | 11/1990 | Scheibel et al. | 252/549 |
| 5,066,425 | 11/1991 | Ofosu-Asante et al. | 252/550 |
| 5,089,174 | 2/1992 | Kaw et al. | 252/553 |
| 5,154,849 | 10/1992 | Visscher et al. | 252/174.15 |
| 5,178,798 | 1/1993 | Joliceur | 252/550 |
| 5,211,870 | 5/1993 | Gilbert et al. | 252/DIG. 16 |
| 5,300,249 | 4/1994 | Schwartz et al. | 252/550 |
| 5,384,061 | 1/1995 | Wise | 252/95 |

FOREIGN PATENT DOCUMENTS

| | | | |
|---|---|---|---|
| 3640541 A1 | 6/1988 | Germany | C11D 17/00 |
| 13778 | 9/1980 | Philippines | C11D 1/00 |
| 2106929 | 4/1983 | United Kingdom | C11D 3/60 |
| 2235207A | 2/1991 | United Kingdom | C11D 3/37 |

*Primary Examiner*—Necholus Ogden
*Attorney, Agent, or Firm*—Daniel F. Nesbitt; Milton B. Graff; Donald E. Hasse

[57] ABSTRACT

Disclosed are compositions of laundry detergent bars that do not develop undesirable brittleness during storage. The disclosed compositions comprise alkyl sulfate surfactant, preferably coconut alkyl sulfate, and polyethylene glycol. The polyethylene glycol prevents the development of undesirable brittleness in such alkyl sulfate-containing laundry bars.

14 Claims, No Drawings

NON-BRITTLE LAUNDRY BARS COMPRISING COCONUT ALKYL SULFATE AND POLYETHYLENE GLYCOL

This is a continuation of application Ser. No. 08/516,969, filed on Aug. 18, 1995, now abandoned, which is a continuation of application Ser. No. 08/261,611, filed on Jun. 17, 1994, now abandoned.

TECHNICAL FIELD

This invention relates to compositions of laundry detergent bars that do not develop undesirable brittleness during storage.

BACKGROUND

Laundry bars containing alkyl sulfate surfactant can become brittle during the storage time between production and use. During storage, the alkyl sulfate and water appear to interact in some manner that causes brittleness by diminishing the water's plasticizing effectiveness. This in-storage brittleness development is especially acute in bars comprising coconut alkyl sulfate.

Coconut alkyl sulfate is a widely used laundry bar surfactant. Coconut alkyl sulfate is based on the renewable resource, coconut oil, and its use is legally mandated in some nations. Its use is especially important in areas where there is a plentiful supply of coconut oil.

Therefore, there is a need for coconut alkyl sulfate-containing laundry bars that do not develop undesirable brittleness during storage.

SUMMARY OF THE INVENTION

It has now been found that alkyl sulfate-containing bars comprising polyethylene glycol develop less brittleness during storage. This invention provides improved brittleness resistant laundry bar compositions comprising alkyl sulfate, preferably coconut alkyl sulfate, and polyethylene glycol. It is preferred that the bars of this invention have a "Brittleness Index" of less than 20. "Brittleness Index" is a predictive indicator of in-storage brittleness development. Bar compositions having a "Brittleness Index" of less than 20 maintain low frequencies of bar breakage and damage in trade distribution. "Brittleness Index" is defined below along with disclosures of the methods for its determination.

The laundry bar compositions of this invention comprise:

1. from about 15% to about 40% anionic surfactant which comprises at least 60%, by weight, $C_{10}$–$C_{20}$ alkyl sulfate, and
2. at least about 0.5% polyethylene glycol.

DETAILED DESCRIPTION OF THE INVENTION

Detergent Surfactant

Laundry bars of the present invention typically comprise 15% to about 40% of an anionic surfactant mixture. The anionic surfactant mixture comprises at least 60%, by weight, alkyl sulfate (AS) having an alkyl chain of from 10 to 20 carbon atoms. It is preferred that the anionic surfactant mixture also comprises branched-chain alkylbenzene sulfonate (ABS) having an alkyl chain of from 10 to 22 carbon atoms. More preferably, it comprises linear-chain alkylbenzene sulfonate (LAS) having an alkyl chain of from 10 to 22 carbon atoms, and mixtures thereof. Preferred bars comprise about 20% to about 40%, more preferably from about 25% to about 35%, of the anionic surfactant mixture comprising alkyl sulfate.

The alkyl chains of the alkyl sulfate surfactant may contain from 10 to 20 carbon atoms, preferably from 12 to 18 carbon atoms. The AS surfactant can comprise a mixture of a longer-chain AS, such as one having 16 to 18 carbons, and a shorter-chain AS such as one having 10–14 carbons. Preferred AS surfactants include coconut alkyl sulfate, palm kernal alkyl sulfate, tallow alkyl sulfate, and mixtures thereof. The most preferred AS is coconut alkyl sulfate. The cation for the anionic surfactant mixture is preferably sodium, although other useful cations include triethanolamine, potassium, ammonium, lithium, or mixtures thereof.

The alkyl portion of said ABS or LAS surfactant preferably contains from 10 to 16 carbon atoms, more preferably from 10 to 14 carbon atoms. Most preferably, the alkylbenzene sulfonate surfactant is LAS.

The preferred anionic surfactant mixtures comprise alkyl sulfate and linear alkylbenzene sulfonate wherein the surfactant mixture comprises at least 60%, by weight, coconut alkyl sulfate, and most preferably at least 85% coconut alkyl sulfate. Laundry bars comprising the preferred surfactant mixtures provide desirable lathering and cleaning performance while making use of biodegradable surfactants and surfactants that are derived from coconut oil, a renewable resource. It is surprising that bars having such high levels of alkyl sulfate, including bars wherein the anionic surfactant comprises 100% coconut alkyl sulfate, can be made without excessive brittleness by the addition of polyethylene glycol according to the present invention.

Polyethylene Glycol

Polyethylene glycol (PEG) has the general formula:

$$HO(C_2H_4O)_nH$$

wherein n represents the degree of polymerization, for example, for tetraethyleneglycol, n=4. Polyethylene can be characterized by degree of polymerization (n or DP) or by molecular weight (MW). The relationship between n and MW is defined by the equation:

$$MW=44n+18$$

By the nature of polymer-forming reactions the products obtained under any one set of conditions comprise a mixture of polymers having a range of molecular weights. The range of molecular weights of the individual polymers in a polyethylene glycol product are typically clustered about an average value. This average molecular weight is used to characterize PEG products and is commonly referred to as the molecular weight of the product. As used herein in reference to PEG products, the term "molecular weight" refers to the average molecular weight of the polymeric mixture.

PEG is available in molecular weights ranging from about 200 to about 20,000. For the compositions of this invention, the preferred molecular weight range is from about 3000 to about 10,000. PEG's of this molecular weight range have low concentrations of low DP polymers that are known to be more hygroscopic than the higher DP polymers. When the molecular weights are above 10000, PEG's are more viscous and higher melting and produce aqueous solutions of higher viscosity.

More preferred are PEG's having molecular weights in the range of about 3350 to about 8000. Within this preferred range, the most preferred PEG's have molecular weights of at least 6000.

The concentration of PEG in the composition can have important effects on brittleness development. There are many factors, such as coconut alkyl sulfate concentration, that may affect what minimum PEG concentration may be required to avoid undesirable brittleness development. In a low-surfactant bar composition comprising as little as 9% coconut alkyl sulfate, brittleness resistance should be improved by adding as little as 0.5% PEG. In high-surfactant bar compositions comprising, for example, 25.5% coconut alkyl sulfate, at least 4% PEG and preferably at least 5% PEG may be required to achieve desirable brittleness resistance.

For economic and formulation flexibility reasons it is desirable to limit the concentration of PEG in the compositions of this invention. It is preferred to limit the PEG concentrations to 10% by weight.

Water

Water is an essential ingredient in laundry bar processing. If there is too much water in the composition, the bars may not be sufficiently firm and may not maintain their desired shape. However, if there is too little water in the composition, the bars may lack integrity and be unacceptably brittle. It has been found that the PEG-containing bars of this invention can maintain acceptable firmness without developing unacceptable brittleness when the moisture composition is at least about 5%, and preferably at least 6%.

Detergent Builder

The laundry bars of the present invention may optionally comprise from about 5% to about 60% by weight detergent builder. Preferred laundry bars comprise from about 5% to about 30% builder, more preferably from about 7% to about 20%, by weight of the bar. These detergent builders can be, for example, water-soluble alkali-metal salts of phosphates, pyrophosphates, orthophosphates, tripolyphosphates, higher polyphosphates, and mixtures thereof. Builders can also be non-phosphate detergent builders. Specific examples of nonphosphorous, inorganic detergency builders include water-soluble inorganic carbonate and bicarbonate salts. The alkali metal (e.g., sodium and potassium) carbonates, bicarbonates, and silicates are particularly useful herein. Also useful are aluminosilicate ion exchange materials. These aluminosilicates can be crystalline or amorphous in structure and can be either naturally occurring or synthetically derived. Preferred synthetic crystalline aluminosilicate ion exchange materials useful herein are available under the designations Zeolite A, Zeolite MAP, Zeolite B, and Zeolite X.

Water-soluble organic detergency builders, for example alkali metal, ammonium and substituted ammonium polycarboxylates, are also useful herein. Specific examples of useful polycarboxylate builder salts include sodium, potassium, ammonium and substituted ammonium salts of ethylenediamine-tetraacetic acid, nitrilotriacetic acid, oxydisuccinic acid, mellitic acid, benzene polycarboxylic acid, polyacrylic acid, polymaleic acid, acrylic acid maleic acid copolymers, polyaspartic acid, and citric acid, or such acids per se.

OPTIONAL COMPONENTS

The detergent bars of the present invention can contain up to about 70% by weight of optional ingredients commonly used in detergent products. Laundry bars of the present invention may also comprise a detergent chelant. Such chelants are able to sequester and chelate alkali metal earth cations, such as magnesium and calcium, and heavy metal ions such as iron.

The detergent chelant may be a phosphonate chelant, particularly one selected from the group consisting of diethylenetriamine penta(methylene phosphonic acid), ethylene diamine tetra(methylene phosphonic acid), and mixtures and salts and complexes thereof, and an acetate chelant, particularly one selected from the group consisting of diethylenetriamine penta(acetic acid), nitrilo triacetate (NTA), ethylene diamine tetra(acetic acid), and mixtures and salts and complexes thereof. Preferred chelants are ethylene diamine disuccinate salts.

Optional detergent surfactants can be included at a level up to about 10%, more preferably from about 0.5 to about 3%, by weight of the composition. The types of detergent surfactants that can be used as optional surfactants include anionic, cationic, nonionic, amphoteric and zwitterionic surfactant, and mixtures thereof.

Optional anionic surfactants useful herein as auxiliary surfactants include:

- Sodium alkyl glyceryl ether sulfates, especially those ethers of higher alcohols derived from tallow and coconut oil;
- Sodium coconut oil fatty acid monoglyceride sulfonates and sulfates;
- Sodium or potassium salts of alkyl phenol ethylene oxide ether sulfates, and sodium or potassium salts of methyl ester R—CH($SO_3$M)—COOR', wherein R is $C_8$–$C_{22}$ alkyl or alkenyl, R' is $C_1$–$C_4$ alkyl, and M is a counter ion, preferably Na or K.
- Secondary alkyl sulfates having an alkyl chain of from 10 to 20 carbon atoms;
- Higher fatty acids (i.e., "soaps") such as the sodium, potassium, ammonium and alkanolammonium salts of higher fatty acids. Soaps can be made by direct saponification of fats and oils or by the neutralization of free fatty acids. Particularly useful are the sodium and potassium salts of the mixtures of fatty acids derived from coconut oil and tallow, i.e., sodium or potassium tallow and coconut soap;
- Alkylalkoxy sulfate comprising an alkyl portion of from 6 to 18 carbon atoms and an alkoxy portion comprising, an average, from about 0.5 to about 20 moles of alkoxy, preferably ethoxy, units, more preferably from about 0.5 to about 5 ethoxy units; and
- Alkyl ethoxy carboxylates of the formula $RO(CH_2CH_2O)_xCH_2COO^-M^+$, wherein R is a $C_6$ to $C_{18}$ alkyl; x ranges from 0 to 10, and the ethoxylate distribution is such that on a weight basis, the amount of material where x is 0 is less than 20%, the amount of material where x is greater than 7 is less than 25%, and wherein the average x is 2–4 when the average R is $C_{13}$ or less, and is 3–6 when R is greater than $C_{13}$; and M is an alkali metal, alkali earth metal, ammonium, mono-, di-, and triethanol ammonium.

Water Soluble salts and esters of alpha-sulfonated fatty acids.

Water soluble salts of olefin sulfonates, and water soluble salts of beta-alkoxy alkane sulfonates.

The term "water soluble", as used herein, indicates the capability of forming a non-precipitating dispersion in water at concentrations and temperatures typically used in laundering.

Other optional surfactants can be nonionic, and can include:

- Alkyl polysaccharides, alkyl polyglucosides, such as described in U.S. Pat. No. 4,565,647, Llenado.
- Polyhydroxy fatty acid amides, of the formula R—C(O)—N(R')—Z, wherein R is $C_5$–$C_{31}$ hydrocarbyl, preferably $C_{11}$–$C_{17}$ alkyl or alkenyl, R' is H, $C_1$–$C_4$ hydrocarbyl, 2-hydroxyethyl, 2-hydroxypropyl, or a mixture thereof, preferably methyl, and Z is polyhydroxy(linear)hydrocarbyl chain having at least 3 hydroxyls directly connected to the chain, preferably $—CH_2—(CHOH)_4—CH_2OH$.

Semi-polar nonionic surfactants, such as water-soluble amine oxides, water-soluble phosphine oxide surfactants, and water-soluble sulfoxide surfactants; and Water-soluble nonionic synthetic surfactants broadly defined as compounds produced by the condensation of ethylene oxide groups (hydrophilic in nature) with an organic hydrophobic compound, which may be aliphatic or alkyl aromatic in nature. The length of the polyoxyethylene group which is condensed with any particular hydrophobic group can be readily adjusted to yield water-soluble compound having the desired degree of balance between hydrophilic and hydrophobic elements.

Cationic surfactants can also be used in the detergent compositions herein and suitable quaternary ammonium surfactants are selected from mono $C_6$–$C_{16}$, preferably $C_6$–$C_{10}$ N-alkyl or alkenyl ammonium surfactants wherein remaining N positions are substituted by methyl, hydroxyethyl or hydroxypropyl groups.

Optional surfactants also include ampholytic surfactants which include aliphatic derivatives of heterocyclic secondary and tertiary amines; zwitterionic surfactants which include derivatives of aliphatic quaternary ammonium, phosphonium and sulfonium compounds. Useful optional zwitterionic surfactants include betaines having the formula $R(R^1)_2N^+R^2COO^-$, wherein R is a $C_6$–$C_{18}$ hydrocarbyl group, preferably a $C_{10}$–$C_{16}$ alkyl group or $C_{10}$–$C_{16}$ acylamido alkyl group, each $R^1$ is typically $C_1$–$C_3$ alkyl, preferably methyl and $R_2$ is a $C_1$–$C_5$ hydrocarbyl group, preferably a $C_1$–$C_3$ alkylene group, more preferably a $C_1$–$C_2$ alkylene group. Examples of suitable betaines include coconut acylamidopropyldimethyl betaine; hexadecyl dimethyl betaine; $C_{12-14}$ acylamidopropylbetaine; $C_{8-14}$ acylamidohexyldiethyl betaine; 4[$C_{14-16}$ acylmethylamidodiethylammonio]-1-carboxybutane; $C_{16-18}$ acylamido-dimethylbetaine; $C_{12-16}$ acylamidopentanediethylbetaine; and [$C_{12-16}$ acylmethylamidodimethylbetaine. Preferred betaines are $C_{12-18}$ dimethyl-ammonio hexanoate and the $C_{10-18}$ acylamidopropane (or ethane) dimethyl (or diethyl) betaines; and the sultaines having the formula $(R(R^1)_2N^+R^2SO_3^-$wherein R is a $C_6$–$C_{18}$ hydrocarbyl group, preferably a $C_{10}$–$C_{16}$ alkyl group, more preferably a $C_{12}$–$C_{13}$ alkyl group, each $R^1$ is typically $C_1$–$C_3$ alkyl, preferably methyl, and $R^2$ is a $C_1$–$C_6$ hydrocarbyl group, preferably a $C_1$–$C_3$ alkylene or, preferably, hydroxyalkylene group. Examples of suitable sultaines include $C_{12}$–$C_{14}$ dimethylammonio-2-hydroxypropyl sulfonate, $C_{12}$–$C_{14}$ amido propyl ammonio-2-hydroxypropyl sultaine, $C_{12}$–$C_{14}$ dihydroxyethylammonio propane sulfonate, and $C_{16-18}$ dimethylammonio hexane sulfonate, with $C_{12-14}$ amido propyl ammonio-2-hydroxypropyl sultaine being preferred.

In addition to the auxiliary surfactants mentioned above, a hydrotrope, or mixture of hydrotropes, can be present in the laundry detergent bar. Preferred hydrotropes include the alkali metal, preferably sodium, salts of tolune sulfonate, xylene sulfonate, cumene sulfonate, sulfosuccinate, and mixtures thereof. Preferably, the hydrotrope, in either the acid form or the salt form, and being substantially anhydrous, is added to the linear alkyl benzene sulfonic acid prior to its neutralization. The hydrotrope will preferably be present at from about 0.5% to about 5% of the laundry detergent bar.

Another particularly preferred component is a detergent enzyme. Particularly preferred are cellulase, lipase, protease, amylase, and mixtures thereof. Enzymes are advantageously used at levels up to 5%.

Another useful optional component of the laundry detergent bars of this invention is silicate, especially sodium silicate. Sodium silicate can be used at up to about 15% silicate solids having a weight ratio of $SiO_2$ to $Na_2O$ between about 1.0:1 and about 3.4:1.

Another preferred additional component is layered sodium silicate, such as the commercially available SKS-6 ($Na_2Si_2O_5$) (Hoechst).

Another preferred optional component of the laundry bars of this invention is fatty alcohol having an alkyl chain of 8 to 22 carbon atoms, more preferably from 12 to 18 carbon atoms, and most preferably from 12 to 14 carbon atoms. Fatty alcohol is effective at reducing the bar wear rate and smear (mushiness) of laundry bars. Typically fatty alcohol is contained in the laundry bar at up to a level of 10%, more preferably from about 0.75% to about 6%, most preferably from about 2% to about 5%. The fatty alcohol is generally added to the formulation of the present invention as free fatty alcohol. However, low levels of fatty alcohol can be introduced into the bars as impurities or as unreacted starting material. For example, laundry bars based on coconut fatty alkyl sulfate can contain, as unreacted starting material, from 0.1% to 3.5%, more typically from 2% to 3%, by weight of free coconut fatty alcohol on a coconut fatty alkyl sulfate basis.

The free fatty alcohol can also serve as a suds booster, for reinforcing and extending suds generation and longevity. For suds boosting, a preferred fatty alcohol has an alkyl chain predominantly having 12 to 14 carbon atoms, used in the composition at a level from about 0.5% to 3%. Preferably, a narrow-cut $C_{12}$ alkyl alcohol is used at a level of 0.5% to 2%.

Other useful components of laundry bars can include soil release polymers. Such soil release polymers can be used at levels up to 5%, preferably at from about 0.05% to about 3%, more preferably from about 0.2% to about 1.0%. A soil release polymer can improve the multi-cycle cleaning of clothes washed with the laundry bar.

Other preferred optional components in the laundry bars are dye transfer inhibiting (DTI) ingredients that can reduce or prevent the detrimental effects of laundering on the color fidelity and color intensity of laundered articles. Effective DTI ingredients include materials that inhibit deposition of fugitives dyes on fabrics and materials that decolorize fugitives dyes. Examples of dye-decolorizing materials are oxidizing agents such as hydrogen peroxide or sources of hydrogen peroxide, such as percarbonate or perborate. Examples of dye-deposition inhibiting materials are polymeric materials. Especially useful are polymeric DTI materials such as polyvinylpyrridine N-oxide, polyvinylpyrrolidone (PVP), PVP-polyvinylimidazole copolymer, and mixtures thereof.

One or more of the polymeric DTI materials can also be combined with one or more of the dye-decolorizing DTI materials. The DTI material combinations may be advantageously used at levels in the bar up to about 10%, preferably from about 0.05% to 5%, more preferably from about 0.2% to about 2%.

Another preferred optional component in the laundry bar is a fabric softener component. A preferred fabric softener component ingredient can include softening clay, such as montmorillonite, bentonite, and hectorite clay, as well as an acid-treated bentonite or other softening clay. The fabric softener component can be added to the bar at a level up to 20%, preferably from about 2% to about 15%. Compositions of this invention containing a softening clay may also advantageously include a polymeric clay-flocculating agent such as polyethylene oxide having molecular weight in the range of about 300000 to about 5000000. The fabric softening agent may be comprised in the compositions of this invention at a concentrations up to 20%, preferably from about 2% to about 15%.

Yet another optional component in the laundry bar is a bleach component. The bleaching component can be a source of $^{-}OOH$ group, such as sodium perborate monohydrate, sodium perborate tetrahydrate and sodium percarbonate. Sodium percarbonate ($2Na_2CO_3.3H_2O_2$) is preferred since it has a dual function of both a source of HOOH and a source of sodium carbonate.

Peroxygen bleaching agents are preferably combined with bleach activators, which lead to the in situ production in aqueous solution (i.e., during the washing process) of the peroxy acid corresponding to the bleach activator. Preferred bleach activators incorporated into compositions of the present invention have the general formula:

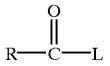

wherein R is an alkyl group containing from about 1 to about 18 carbon atoms wherein the longest linear alkyl chain extending from and including the carbonyl carbon contains from about 6 to about 10 carbons atoms and L is a leaving group, the conjugate acid of which has a PKa in the range of from about 4 to about 13. An example of such a preferred bleach activator is nonanoyl oxy benzene sulfonate (NOBS).

Another optional bleaching component is a peracid such as one having the general formula:

$$CH_3(CH_2)_w—NH—C(O)—(CH_2)_zCO_3H$$

wherein z is from 2 to 4 and w is from 4 to 10. (The compound of the latter formula where z is 4 and w is 8 is hereinafter referred to as NAPAA).

The bleach components can be added to the bar at a level up to 20%, preferably from about 1% to about 10%, more preferably from about 2% to about 6%.

Sodium sulfate is a well-known filler that is compatible with the compositions of this invention. It can be a by-product of the surfactant sulfation and sulfonation processes, or it can be added separately.

Calcium carbonate (also known as Calcarb) is also a well known and often used filler component of laundry bars. Such materials are typically used at levels up to 40%, preferably from about 5% to about 25%.

Binding agents for holding the bar together in a cohesive, soluble form can also be used, and include natural and synthetic starches, gums, thickeners, and mixtures thereof. Some binding agents can also serve as soil suspending agents, and can include such as water-soluble salts of carboxymethylcellulose and carboxyhydroxymethylcellulose.

Glycerin is commonly incorporated in laundry bar compositions at concentrations in the range of about 0.5% to about 1.5%. Glycerin can affect bar brittleness.

A preferred soil suspending agent which can optionally be used is an acrylic/maleic copolymer, commercially available as Sokalan®, from BASF Corp. Other soil suspending agents include ethoxylated mono- and polyamines, and quaternary salts thereof.

Dyes, pigments, optical brighteners, germicides, and perfumes can also be added to the bar composition.

Bar Processing

The detergent laundry bars of the present invention can be processed in conventional soap or detergent bar making equipment with some or all of the following key equipment: blender/mixer, mill or refining plodder, two-stage vacuum plodder, logo printer/cutter, cooling tunnel, and wrapper.

In a typical process, the raw materials are mixed in the blender. When the composition comprises alkylbenzene sulfonate, a typical source of may be alkylbenzene sulfonic acid. In this situation, the alkylbenzene sulfonic acid is added into a mixture of alkaline inorganic salts to form a partially neutralized mixture that is further worked in the blender to achieve a homogeneous blend and completely neutralized alkylbenzene sulfonate salt. Once the neutralization reaction is completed, the alkyl sulfate surfactant is added.

In making the bars of this invention, alkyl sulfate may be added to the component blend in the form of either dry solid particles, surfactant paste, or mixtures thereof. The preferred method of adding polyethylene glycol to the compositions of this invention depends on the source of water added to the blend. When the paste form of alkyl sulfate is used, polyethylene glycol is dissolved in the aqueous surfactant paste. If only dry alkyl sulfate is used, polyethylene glycol is pre-dissolved in the free water to be added to the bar. The method by which PEG is added can affect the brittleness development properties of the resulting bar. Adding PEG dispersed either in water or in aqueous surfactant paste is preferred over simply adding flaked PEG to the blend.

Following the addition of the alkyl sulfate, the remaining dry ingredients, except phosphate, are added. Next, the free water (which may contain poly-ethylene glycol), glycerin, Sokolan®, and other optional ingredients are added.

Finally, any builder salts are added, followed by perfume. Mixing of all of these ingredients is then carried out for several minutes to an hour, the usual time being 5–20 minutes. The mixing temperatures are typically in the range of 120 to 140° F. The blender mix is discharged to a surge tank and subsequently conveyed to the mill or refining plodder.

After milling or preliminary plodding the product is then conveyed to a double stage vacuum plodder, operating at a high vacuum, e.g., 600 to 740 millimeters of mercury vacuum, so that entrapped air is removed. The product is extruded and cut to the desired bar length, and printed with the product brand name. The printed bar can be cooled, for example, in a cooling tunnel before it is wrapped, cased, and sent to storage.

Test Methods

Brittleness Tests

After manufacture, the syndet bars are stored at 80° and 90° F., and tested for brittleness over time by the following methods:

1). Torque Resistance—Inch-pounds required to twist bar 30° around its length axis. If the bar breaks, it is considered to be brittle and is given a "100" grade. Bars that do not break are given a "0" grade.

2). Impact Resistance—Three-inch lengths of syndet bars are manually tossed from a measured 42-inch height to land flat on a tiled floor a targeted 42 inches away. Typically, 4 samples are tossed, and the number of broken bars is recorded. The percentage of broken samples is recorded as the brittleness grade.

3). Shear Resistance—A full length sample bar is clamped vertically and impacted with a pivoting assembly. The pivoting assembly is moved, by gravity, through an angle of 30 degrees before impacting the test bar sample. Numerical grades are assigned according to the type of indentation or fracture the bar exhibits after impact by the pivoting assembly. Numerical grades are assigned as follows: "0" for no effect or simply a dent; "25" for a slight or small break; "50" for a V-shaped fracture, but with no dislodged pieces; and "100", a piece dislodged from the bar.

Brittleness Index

Average of Numerical grades of these three tests at 80° F. and 90° F.

The pendulum fracture test is conducted as follows: A full length sample bar is positioned vertically in a clamp directly below a pivot point. To this pivot point is pivotally attached one end of a 16.5 inch long copper tube having a diameter of ⅜ inch. To the other end of this copper tube is attached a square rod having a thickness of ¼ inch. The square rod is attached, at a point along its length, to the copper tube so that the center line of the rod is perpendicular to the center line of the copper tube and so that the centerline of the rod is effectively congruent with the coppers tube's line of rotation about the pivot point. Thusly positioned, a sharp edge of the square rod will strike the sample bar when the pivoting assembly is allowed to swing freely.

Between the point of attachment of the copper tube and the square rod and the non-impact end of the square rod is attached a weight. The weight is selected so that the total weight of the pivoting assembly is 238 grams, including the weights of the copper tube, the square rod, and the attached weight. The sample bar is positioned so that the square rod strikes the sample bar on a corner edge at 5½ inches above the bottom end edge of the vertically positioned sample bar.

In the standard test, the pivoting assembly is released for impact from a position wherein a line from the impact end of the square rod through the pivot point subtends a 30 degree angle with the vertical.

EXAMPLES

Bar Preparation Method

Except for Example 3 (randomly selected commercial plant production), the bars of the following examples of laundry bar compositions are prepared in a pilot plant in 35–50 lb batches. The compositions of Examples 4–19 comprise coconut fatty alcohol sulfate (CFAS) as the only surfactant. The compositions of examples 2 and 20–25 comprise mixtures of CFAS and LAS. The CFAS in these examples is added in the form of powder, extrudates or aqueous paste. When CFAS is added in extrudate form or powder form, the polyethylene glycol (PEG) is added to the blender in the form of an aqueous mixture that also comprises SOKALAN® and glycerin. When CFAS is added in paste form, PEG is melted and mixed into the paste, prior to addition to the blender.

The basic compositions of Examples 4–19, to which the PEG is added, comprise CFAS (22–30%), TSPP(5%), STPP (5%), Na2CO3(20%), water(6–7.5%), coconut fatty alcohol (2.6%), glycerin(0.4%), Sokalan®(0.4%), PVP(1%), CMC (0.7%), and Na2SO4(2– 22%), along with various amounts of calcium carbonate as filler and small amounts of brightener, TiO2, perfume, and dye.

The compositions of examples 20–25 comprise essentially the same materials except that the surfactant comprises a mixture of CFAS and LAS.

The various ingredients are first blended in a plow-share or ribbon type blenders, in a specified order of addition, usually in the order CFAS, CFA, all dry materials except phosphate, a PEG-water-glycerin-Sokalan® pre-mixture, water, phosphate, perfume. When CFAS is added as a 72% active paste, a PEG-paste mixture is added to a blend of all the powders except phosphate, which is added next to last. Mixing is carried out for approximately 15 minutes.

When the blend is mixed in a ribbon blender, the powdery or lumpy mixture is passed through a 3 roll mill to achieve intimate mixing of the ingredients. The milling step may be omitted when the blend is mixed in a plow-share mixer.

Next, the batch of homogeneously mixed material is continuously fed into a 2-stage, vacuum, twin screw extruder (plodder). The plodded bars are recycled to the feed of the plodder until the bar temperature reached 130°–135° F., at which temperature, the bars become smooth and may be flexed without breaking.

Sample bars are cut to typical lengths and stored at 80° and 90° F. for two weeks, after which time they are tested for brittleness. The results of these test are reported as "Brittleness Index".

Bar Brittleness Testing Results

| | | | Formulation, wt % | | | | | | |
|---|---|---|---|---|---|---|---|---|---|
| Ex. | CFAS | Form | ABS | LAS | $H_2O$ | Na2SO4 | PEG | Brit. Index | |
| 1 | 18 | extr | 12 | 0 | 2.4 | 2 | 0 | 23 | Mixed surfactant bars |
| 2 | 25 | extr | 0 | 5 | 2.5 | 2 | 0 | 24 | Mixed surfactant bars |
| 3 | 25 | extr | 0 | 5 | 2.5 | 2 | 0 | 20 | (Plant production) |
| 4 | 30 | extr | 0 | 0 | 6.0 | 2.3 | 0 | 96 | All CFAS bars |
| 5 | 30 | extr | 0 | 0 | 2.6 | 2.3 | 0 | 95 | All CFAS bars |
| 6 | 30 | pwdr | 0 | 0 | 7.5 | 19 | 5(8000MW) | 0 | All CFAS bars |
| 7 | 30 | pwdr | 0 | 0 | 7.5 | 20 | 4(8000MW) | 21 | All CFAS bars |
| 8 | 30 | pwdr | 0 | 0 | 7.5 | 21 | 3(8000MW) | 67 | All CFAS bars |

-continued

| Bar Brittleness Testing Results Formulation, wt % | | | | | | | | | |
|---|---|---|---|---|---|---|---|---|---|
| Ex. | CFAS | Form | ABS | LAS | $H_2O$ | Na2SO4 | PEG | Brit. Index | |
| 9 | 30 | pwdr | 0 | 0 | 7.5 | 19 | 5(3350MW) | 0 | All CFAS bars |
| 10 | 30 | pwdr | 0 | 0 | 7.5 | 20 | 4(3350MW) | 15 | All CFAS bars |
| 11 | 30 | pwdr | 0 | 0 | 7.5 | 21 | 3(3350MW) | 48 | All CFAS bars |
| 12 | 30 | pst/ex | 0 | 0 | 6.0 | 21 | 4(3350MW) | 10 | All CFAS bars |
| 13 | 30 | extr | 0 | 0 | 6.0 | 2.3 | 5(8000MW) | 4 | All CFAS bars |
| 14 | 30 | pst/ex | 0 | 0 | 6.0 | 20 | 4(8000MW) | 2 | All CFAS bars |
| 15 | 30 | pst/ex | 0 | 0 | 6.7 | 2.3 | 5(8000MW) | 0 | All CFAS bars |
| 16 | 30 | extr | 0 | 0 | 9.0 | 2.3 | 5(8000MW) | 17 | All CFAS bars |
| 17 | 30 | pst/ex | 0 | 0 | 7.5 | 2.3 | 5(8000MW) | 4 | Contains 19% NaHCO3 |
| 18 | 30 | pst/ex | 0 | 0 | 6.0 | 20 | 5(8000MW) | 0 | All CFAS bars |
| 19 | 22 | extr | 0 | 0 | 6.0 | 2.3 | 5(8000MW) | 13 | All CFAS bars |
| 20 | 25.5 | pwdr | 0 | 4.5 | 6.0 | 2.0 | 0 | 31 | CFAS/LAS bars |
| 21 | 25.5 | pwdr | 0 | 4.5 | 6.0 | 2.0 | 3(PEG8000) | 75 | CFAS/LAS bars |
| 22 | 25.5 | pwdr | 0 | 4.5 | 6.0 | 2.0 | 5(PEG8000) | 0 | CFAS/LAS bars |
| 23 | 25.5 | pwdr | 0 | 4.5 | 5.0 | 2.0 | 0 | 38 | CFAS/LAS bars |
| 24 | 25.5 | pwdr | 0 | 4.5 | 5.0 | 2.0 | 3(PEG8000) | 83 | CFAS/LAS bars |
| 25 | 25.5 | pwdr | 0 | 4.5 | 5.0 | 2.0 | 5(PEG8000) | 2 | CFAS/LAS bars |

* - extr = CFAS in ⅛" diameter extrudates
* - pwdr = CFAS ground to through 14, on 65 mesh screen
* - pst/ex = 50/50 mix of CFAS paste (72% active) and CFAS extrudates

Example 26

Synthetic detergent laundry bars are made using the conventional steps of blending, transferring to a feed hopper, and then plodding using a two-stage vacuum plodder. The blending step comprises mixing alkylbenzene sulfonic acid with all of the sodium carbonate and zeolite to neutralize the acid. After 4–5 minutes, part of the CFAS as dried flakes is added, followed by addition of sodium tripolyphosphate (STPP), tetrasodium pyrophosphate (TSPP), and calcium carbonate. The appropriate amount of PEG 8000 is then melted at 150–160° F. and mixed thoroughly into the remainder of the CFAS (as paste), also heated to 150° F. This CFAS paste/PEG mixture (at 140–160° F.) is then added while mixing and is mixed until a coarse granular texture is achieved. Dry minors are then added. Sodium sulfate, brighteners, dry colorants, Sokalan® CP-5 polymer and mixed until the mix goes from a dough to a coarse granular mix. Additional coconut fatty alcohol (CFA) is added to sum with the unreacted up to target level, and perfume is added last. A mixer jacket is often used with approximately 160° F. water, and the mix is roughly 120° F. when unloaded.

The moist granular mix is unloaded with little further mixing and is transferred (with 5–10 minutes delay) to the feed hopper for the two-stage vacuum plodder. Jacketing of the plodder can be adjusted to give a range of bar temperatures at the exit die, ideally 125–150° F. The ability of the hot water jacketing to heat the mix in mixer and/or plodder is often limited, so the heat contributed by preheated feedstocks such as surfactant paste is often very important for achieving minimum temperatures for plodding.

The following detergent bar composition is produced:

| Ingredient | Weight % Active Material |
|---|---|
| CFAS | 25.5 |
| LAS | 4.5 |
| STPP | 5.0 |
| TSPP | 5.0 |
| Sodium Carbonate | 20.0 |
| Sodium Sulfate | 5.0 |
| Calcium Carbonate | 16.5 |
| Zeolite | 2.0 |
| PEG-[0007]8000 | 5.0 |
| Water | 7.0 |
| Sokalan Polymer | 0.4 |
| CFA (total) | 2.5 |
| Minors (perfume, brightener, and colorants) | 1.6 |

What is claimed is:

1. A laundry detergent bar composition comprising, by weight:

a. from about 25% to about 40% anionic surfactant component comprising at least about 60% $C_{10}$–$C_{20}$ alkyl sulfate, b. from about 4% to about 10% polyethylene glycol having a molecular weight of from about 3000 to about 10,000, c. from about 5% to about 20% phosphate detergent builder;

d. at least about 5% water;

wherein the laundry bar has a "Brittleness Index" of less than about 20.

2. The composition of claim 1 wherein the anionic surfactant component comprises at least about 85% $C_{12}$–$C_{18}$ alkyl sulfate, and from 0% to about 15% $C_{10}$–$C_{16}$ alkylbenzene sulfonate.

3. The composition of claim 1 wherein the composition comprises from about 4% to about 5% of the polyethylene glycol.

4. The composition of claim 2 wherein the composition comprises from about 4% to about 5% of the polyethylene glycol.

5. A laundry detergent bar composition consisting essentially of, by weight:

a. from about 25% to about 40% anionic surfactant component comprising at least about 60% $C_{10}$–$C_{20}$ alkyl sulfate;

b. from about 4% to about 10% polyethylene glycol having a molecular weight of from about 3000 to about 10,000;

c. from about 5% to about 20% phosphate detergent builder;

d. at least about 5% water;

e. from 0% to about 30% non-phosphate detergent builders selected from the group consisting of water-soluble inorganic carbonate and bicarbonate salts, aluminosilicate ion exchange materials, and polycarboxylates;

f. from 0% to about 70% optional ingredients selected from the group consisting of detergent chelants, cationic surfactants, nonionic surfactants, amphoteric surfactants, zwitterionic surfactants, hydrotropes, enzymes, fatty alcohol, soil release polymers, dye transfer inhibiting ingredients, fabric softeners, bleach components, bleach activators, sodium sulfate, calcium carbonate, binding agents, glycerine, soil suspending agents, dyes, pigments, optical brighteners, germicides, and perfumes;

wherein the laundry bar has a "Brittleness Index" of less than about 20.

6. The composition of claim 5 wherein the non-phosphate detergent builders are selected from the group consisting of water-soluble inorganic carbonate and bicarbonate salts, and polycarboxylates.

7. The composition of claim 5 or 6 wherein the anionic surfactant component comprises at least about 85% $C_{12}$–$C_{18}$ alkyl sulfate, and from 0% to about 15% $C_{10}$–$C_{16}$ alkylbenzene sulfonate; the composition comprises from about 5% to about 7.5% water; and the laundry bar has a "Brittleness Index" of less than about 20.

8. A method for providing improved brittleness resistance to a laundry bar composition, the composition comprising from about 25% to about 40% anionic surfactant component comprising at least about 60% $C_{10}$–$C_{20}$ alkyl sulfate and from about 5% to about 20% phosphate detergent builder, by the addition to the composition of from about 4% to about 10% polyethylene glycol having a molecular weight of from about 3000 to about 10,000 and at least about 5% water; wherein the laundry bar has a "Brittleness Index" of less than about 20.

9. The method of claim 8 wherein the polyethylene glycol is added to the composition dispersed either in water or in aqueous surfactant paste.

10. The method of claim 9 wherein the anionic surfactant component comprises at least about 85% $C_{12}$–$C_{18}$ alkyl sulfate, and from 0% to about 15% $C_{10}$–$C_{16}$ alkyl benzene sulfonate; and wherein the laundry bar has a "Brittleness Index" of less than about 20.

11. The method of claim 10 wherein from about 4% to about 5% of the polyethylene glycol is added to the composition.

12. The method of claim 8 or 11 wherein the composition is free of silicates and aluminosilicate builders.

13. The composition of claim 1 wherein the composition is free of aluminosilicate builders.

14. The composition of claim 1 wherein the composition is free of silicates.

* * * * *